US008261881B2

(12) United States Patent
Plaze et al.

(10) Patent No.: US 8,261,881 B2
(45) Date of Patent: Sep. 11, 2012

(54) MULTIFUNCTIONAL BELAY DEVICE FOR A ROPE

(75) Inventors: Pierre Plaze, Chambery (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 346 days.

(21) Appl. No.: 12/588,999

(22) Filed: Nov. 4, 2009

(65) Prior Publication Data

US 2010/0122873 A1 May 20, 2010

(30) Foreign Application Priority Data

Nov. 19, 2008 (FR) ..... 08 06464

(51) Int. Cl.
*A62B 1/20* (2006.01)

(52) U.S. Cl. ..... 182/193; 182/5

(58) Field of Classification Search ..... 182/5, 193; 188/65.4, 65.2
See application file for complete search history.

(56) References Cited

U.S. PATENT DOCUMENTS

| | | | | |
|---|---|---|---|---|
| 3,814,210 | A * | 6/1974 | Hoffman | 182/6 |
| D413,786 | S * | 9/1999 | Graham | D8/356 |
| D466,794 | S * | 12/2002 | Malkiel | D8/356 |
| 6,681,891 | B2 * | 1/2004 | Richard et al. | 182/5 |
| 6,959,783 | B2 * | 11/2005 | Kwak et al. | 182/5 |
| 7,353,910 | B2 * | 4/2008 | Klingler | 182/5 |
| D586,001 | S * | 2/2009 | Petzl | D25/69 |
| 7,500,290 | B2 * | 3/2009 | Klingler | 24/115 R |
| D593,844 | S * | 6/2009 | Petzl | D8/356 |
| 2002/0084139 | A1 * | 7/2002 | Richard et al. | 182/5 |
| 2005/0236444 | A1 * | 10/2005 | Thompson | 224/150 |
| 2008/0011543 | A1 | 1/2008 | Klingler | |
| 2008/0011544 | A1 * | 1/2008 | Klingler | 182/5 |
| 2008/0302600 | A1 * | 12/2008 | Murray | 182/5 |
| 2009/0026011 | A1 * | 1/2009 | Petzl et al. | 182/5 |
| 2011/0011671 | A1 * | 1/2011 | Chu | 182/5 |
| 2011/0284323 | A1 * | 11/2011 | Ayre | 182/5 |

FOREIGN PATENT DOCUMENTS

| | | |
|---|---|---|
| DE | 71 46 100 U | 3/1972 |
| WO | WO 2007/080316 A2 | 7/2007 |

OTHER PUBLICATIONS

French Search Report issued Jun. 26, 2009 (With Translation).

* cited by examiner

*Primary Examiner* — Katherine W Mitchell
*Assistant Examiner* — Candace L Bradford
(74) *Attorney, Agent, or Firm* — Oliff & Berridge, PLC

(57) ABSTRACT

A belay device for a rope, comprising a plate having at least one slot for a loop of the rope to pass through, a retaining element integral to the plate, and a carabiner connected to the retaining element by means of a securing part rendering it captive with respect to the plate. The carabiner is fitted with bidirectional sliding in the securing part to come up against the stop formed by the plate when blocking the rope or to move away from the latter when releasing is performed.

3 Claims, 5 Drawing Sheets

MULTIFUNCTIONAL BELAY DEVICE FOR A ROPE

BACKGROUND OF THE INVENTION

The invention relates to a belay device for a rope, comprising a plate having at least one slot for a loop of the rope to pass through, a retaining element integral to the plate and a carabiner connected to the retaining element by means of a securing part rendering the latter captive with respect to the plate.

Such a belay device is designed to accompany and secure the progression of climbers along a rope, in particular the progression of the leader who is belayed by the second climber in the event of a fall. It can also serve the purpose of belaying the second climber when the leader has reached a secured point. In addition to the functions of belaying the leader or the second climber, the device also enables rappelling ensuring safety of rapelling of the person by enabling him or her to slow down the speed of descent.

STATE OF THE ART

The document WO 2007/080316 describes a device of the above-mentioned kind having a small plate with two slots, a retaining element in the form of a shackle made from elastically deformable flexible material, and a carabiner rigidly fixed to the shackle by a securing part. The spring effect of the shackle imposes a fixed bearing point on the carabiner. In the event of a fall, the tension of the rope pulls the carabiner towards the plate due to elastic deformation of the shackle. In the maximum deformation state of the shackle, a gap does however remain separating the carabiner from the plate. The presence of this gap is liable to result in a certain sliding of the rope in case of belaying a second climber.

OBJECT OF THE INVENTION

The object of the invention consists in providing a self-locking multifunctional belay device on a double or single rope, with optimum safety, and that is easy to implement and to shackle for a right-handed or a left-handed user.

According to the invention, the retaining element is rigid or semi-rigid and the carabiner is mounted with bidirectional sliding in the securing part to come up against the stop formed by the plate when the rope is blocked or to move away from the latter when releasing is performed. Free sliding of the carabiner prevents deformation by spring effect of the retaining element and facilitates operation of the belay device.

According to a preferred embodiment, the securing part is formed by a clip comprising a hole for the carabiner to pass through with clearance. The clip is made from plastic and is formed by two parts that clip onto the retaining element.

The retaining element can be formed by a semi-rigid cable in the form of a shackle or by a rigid arm forming part of the plate.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION OF THE INVENTION

Figure 1:
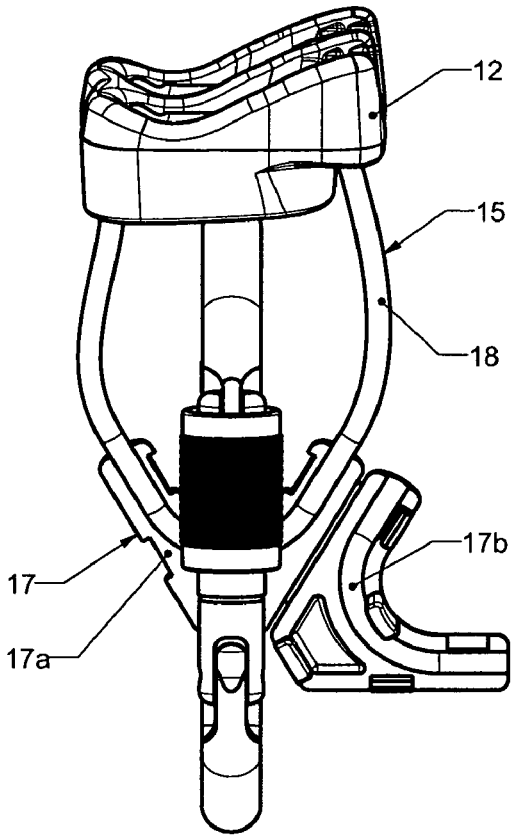
FIG. 1 represents an elevational view of a first embodiment of the belay device according to the invention, the clip being shown in the open state for fitting the carabiner onto the cable of the securing part.

In FIGS. 1 to 9, a belay and rappelling device 10 for a rope 11 is composed of a small metal plate 12 with two slots 13, 14, a retaining element 15 extending perpendicularly to the plate 12, and a carabiner 16 connected to retaining element 15 by a securing part 17.

Retaining element 15 is formed for example by a semi-rigid cable 18 in the form of a shackle, the two opposite ends whereof are fixed to plate 12 by crimping or any other assembly method.

The two oblong slots 13, 14 are parallel and arranged side by side being separated from one another by an intermediate wall 19 whereto cable 18 of retaining element 15 is fixed. Cable 18 is preferably made of steel, enveloped in a sheath of circular cross-section made from plastic.

Securing part 17 of carabiner 16 is formed for example by a clip made from plastic having two parts 17*a*, 17*b* that clip onto cable 18. Part 17*a* comprises a protuberance wherein a hole 20 is arranged allowing a limited bidirectional sliding movement of carabiner 16 between a position up against the stop formed by plate 12 when rope 11 is blocked (FIG. 6) and a separated position when releasing is performed (FIG. 7). The two parts 17*a*, 17*b* are advantageously joined to one another by a hinge enabling the clip to be opened or closed.

Each part 17*a*, 17*b* of the clip is in the shape of a V, the two guiding branches whereof have a semi-circular cross-section having a slightly larger diameter than that of cable 18. In the assembled position (FIGS. 4 and 5), coming into abutment of the two parts 17*a*, 17*b* fastens the clip on cable 18 with the formation of a slight clearance enabling the clip to be moved by sliding along the central area of cable 18.

Figure 3:
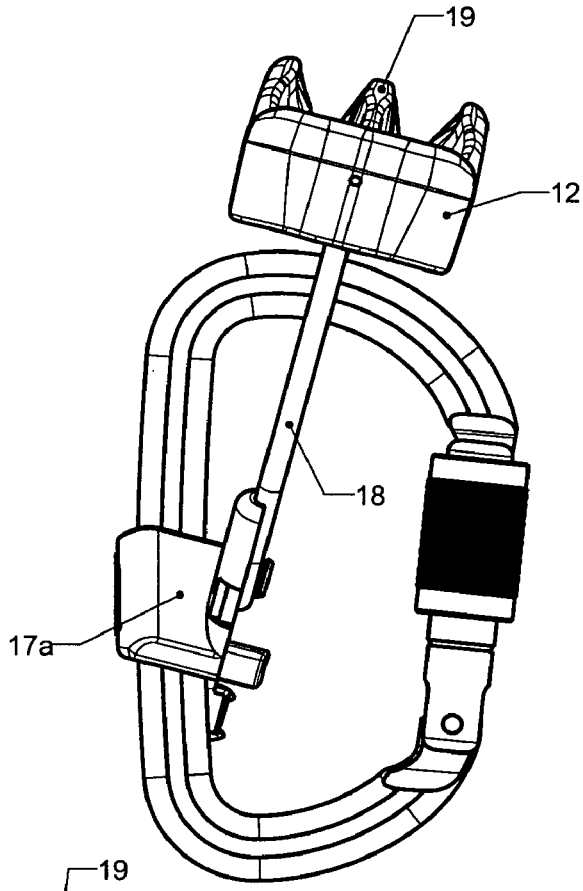
FIG. 3 shows a side view of FIG. 1.
Figure 2:
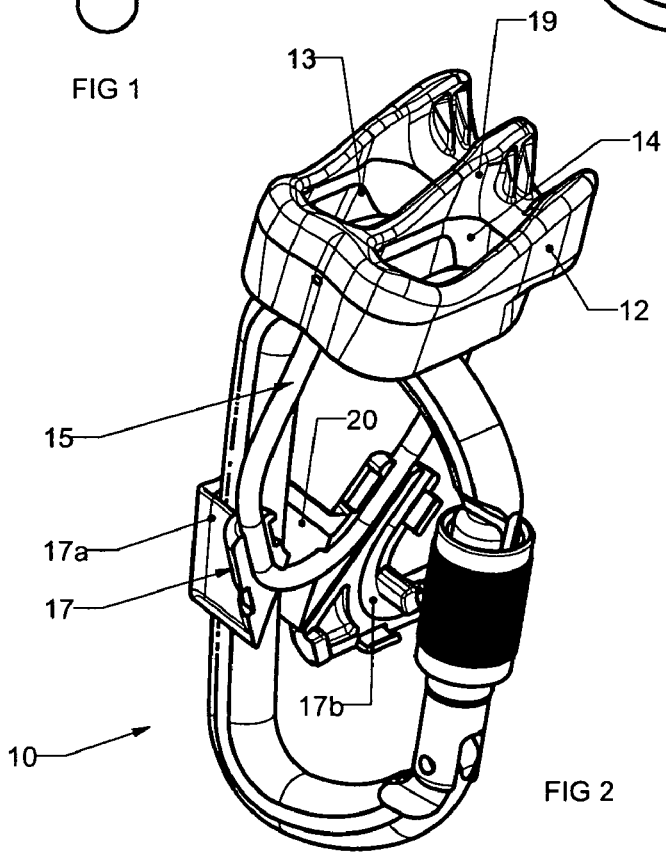
FIG. 2 is a perspective view of FIG. 1.
Figure 4:
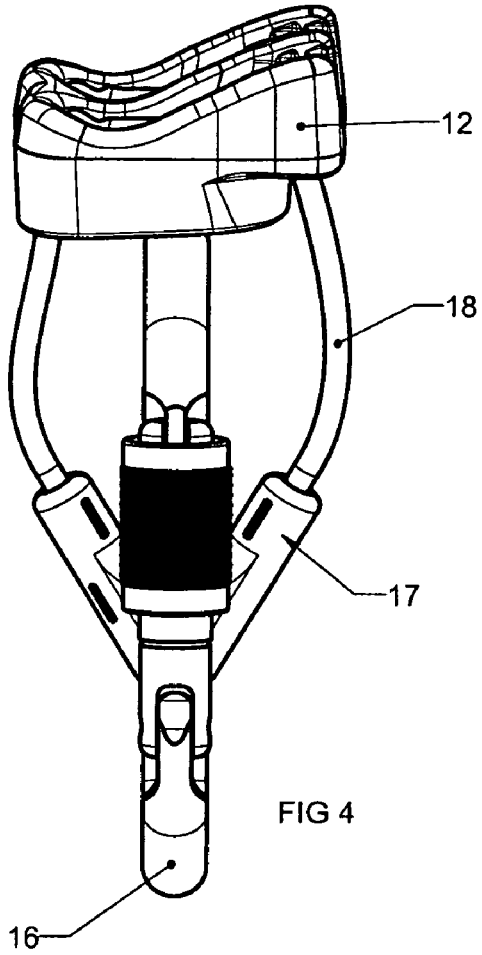
FIGS. 4 and 5 are identical views to FIGS. 1 and 2 when the clip is in the closed state rendering the carabiner captive while at the same time allowing the latter to slide.
Figure 5:
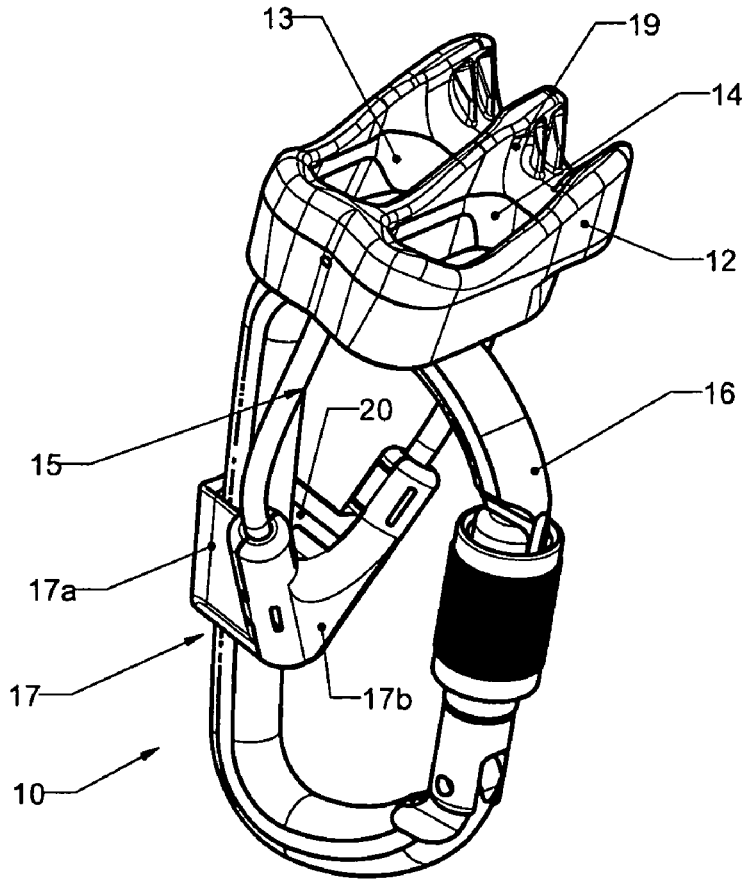

Fitting carabiner 16 in hole 20 of part 17*a* is performed when the clip is open (FIGS. 1 to 3). The guide branches of part 17*a* then simply have to be placed on cable 18 and the complementary other part 17*b* be folded over to close the clip (FIGS. 4 and 5). Carabiner 16 is thus fitted captive following clip-fastening of the clip on cable 18.

Figure 8:
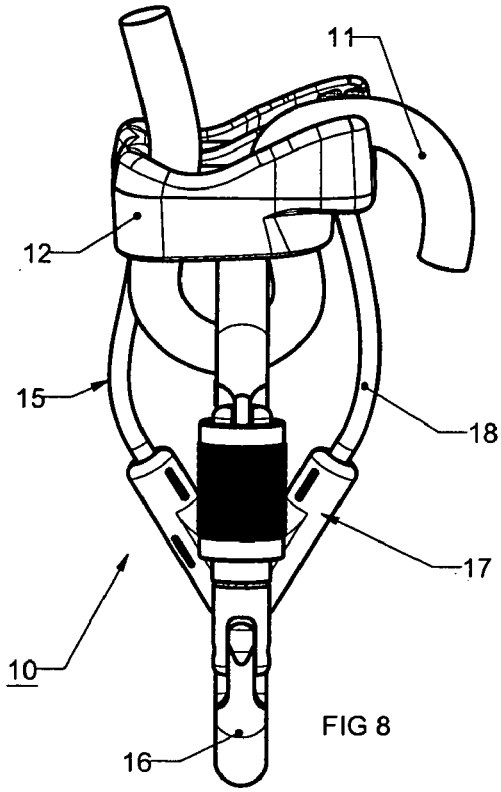
FIGS. 8 and 9 are identical views to FIG. 4 after a single rope has been fitted and respectively for a right-handed and a left-handed user.

Belay device 10 can be used with a single rope or a double rope. FIG. 8 shows the example of a single rope, one loop of which rope 11 passes in one of slots 13, 14 of plate 12. Carabiner 16 passes perpendicularly through the rope loop after its pivoting finger has been opened, and is simultaneously secured to the user's harness (not shown).

In FIG. 7, carabiner 16 is separated from plate 12 and allows rope 11 to run freely during normal progression of the leader secured to the top strand of the rope.

Figure 6:
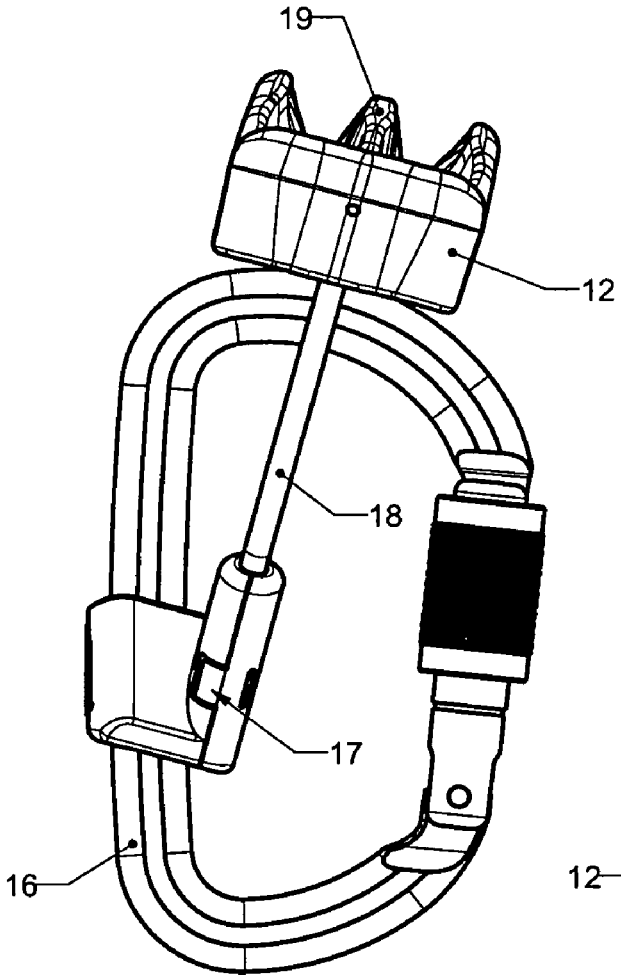
FIGS. 6 and 7 are identical views to FIG. 3, when the clip is closed and when the carabiner is respectively in the position up against the stop formed by the plate and in the separated position.
Figure 7:
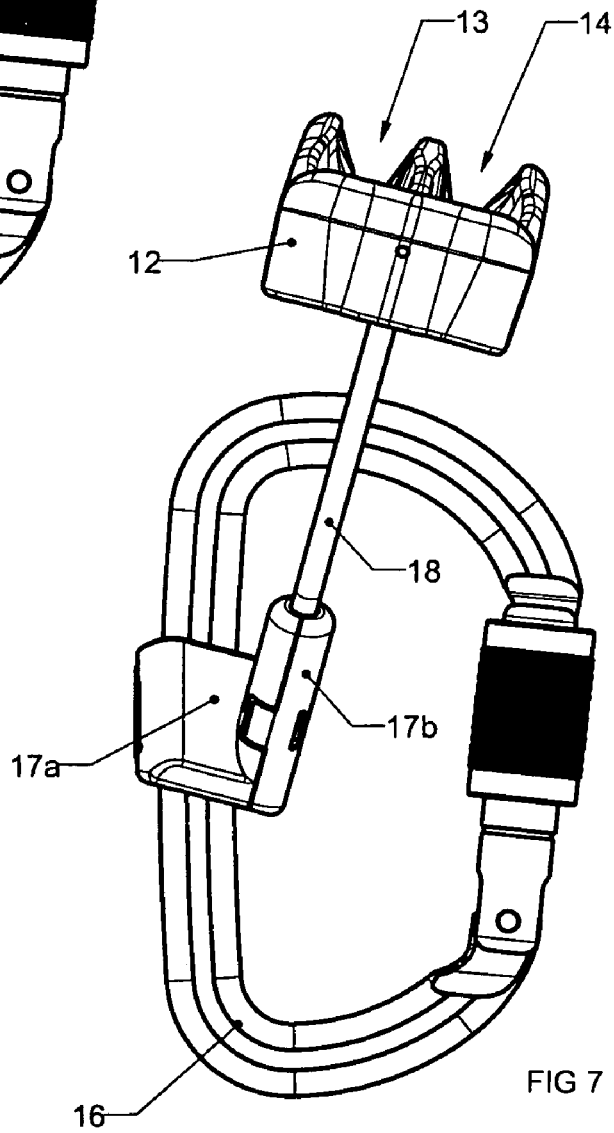

In FIG. 6, the leader falling causes rope 11 to be blocked after carabiner 16 has slid against plate 12. Carabiner 16 is moved freely in hole 20 of the clip by the tension of rope 11 until it comes up against the stop formed by plate 12 to confirm blocking.

Figure 9:
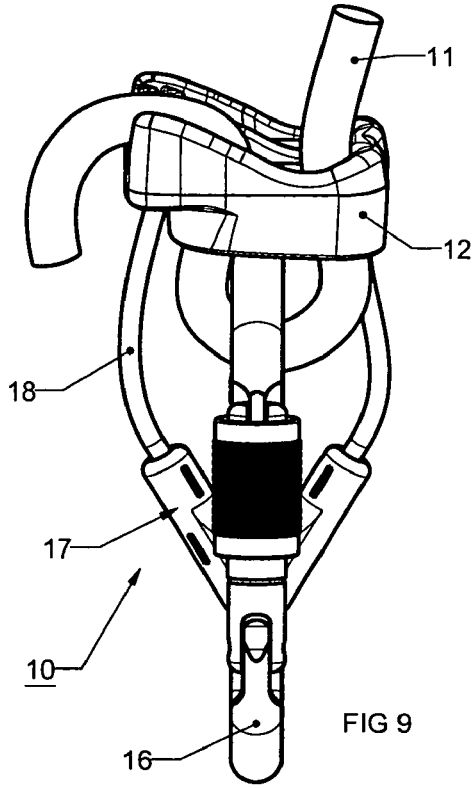

FIGS. 8 and 9 represent device 10 respectively for a right-handed and a left-handed user. Carabiner 16 is secured to the user's harness and his or her right or left hand controls the bottom strand of rope 11 to belay the leader. Switching from right-hand to left-hand mode or vice-versa is achieved by inverting plate 12, securing part 17 being adaptable on cable 18 regardless of the mode selected. The device also enables a second climber to be belayed in top-rope manner.

Figure 10:
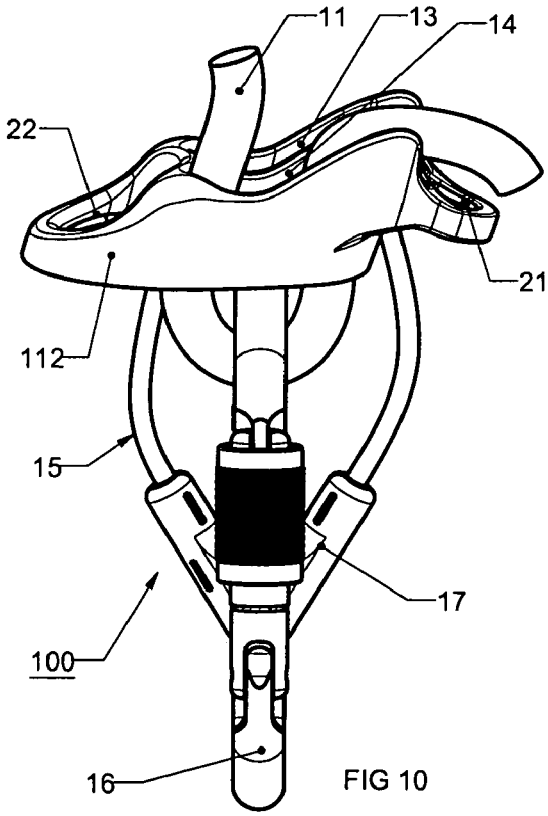
FIGS. 10 and 11 are identical views to FIGS. 8 and 9 of an alternative embodiment.
Figure 11:
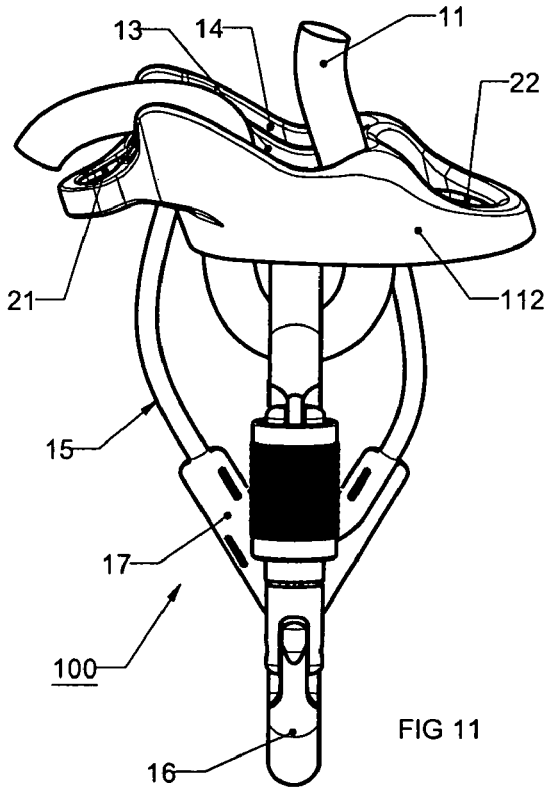

FIGS. 10 and 11 represent an alternative embodiment of a multifunctional belay device 100 with a plate 112 having, in addition to the two slots 13, 14, a pair of additional holes 21, 22 arranged on each side of the two slots 13, 14 along the longitudinal direction. Device 100 is used on a double or single rope and enables the leader or second climber to be belayed and in addition performs the descender function.

Figure 12:
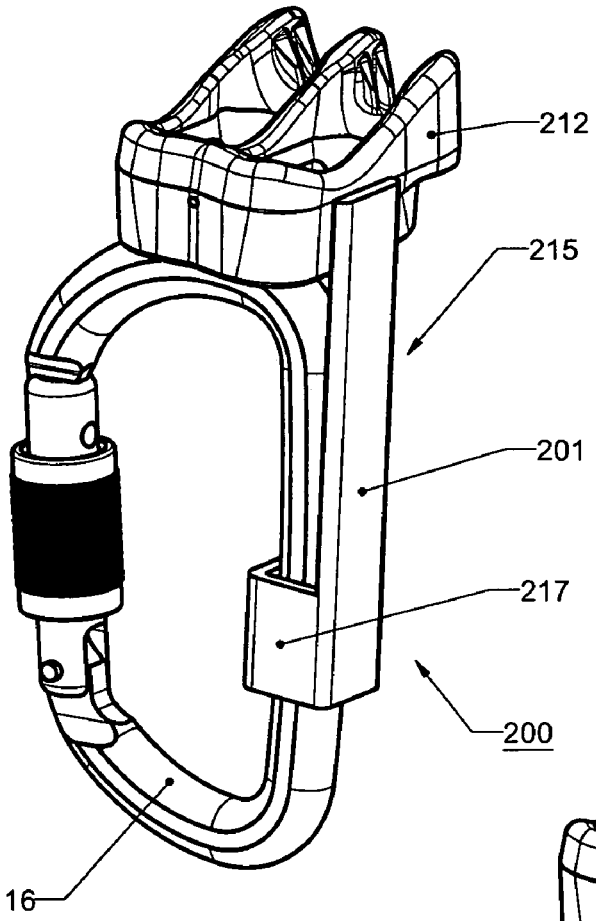
FIGS. 12 and 13 are identical views to FIGS. 6 and 7 of another alternative embodiment.
Figure 13:
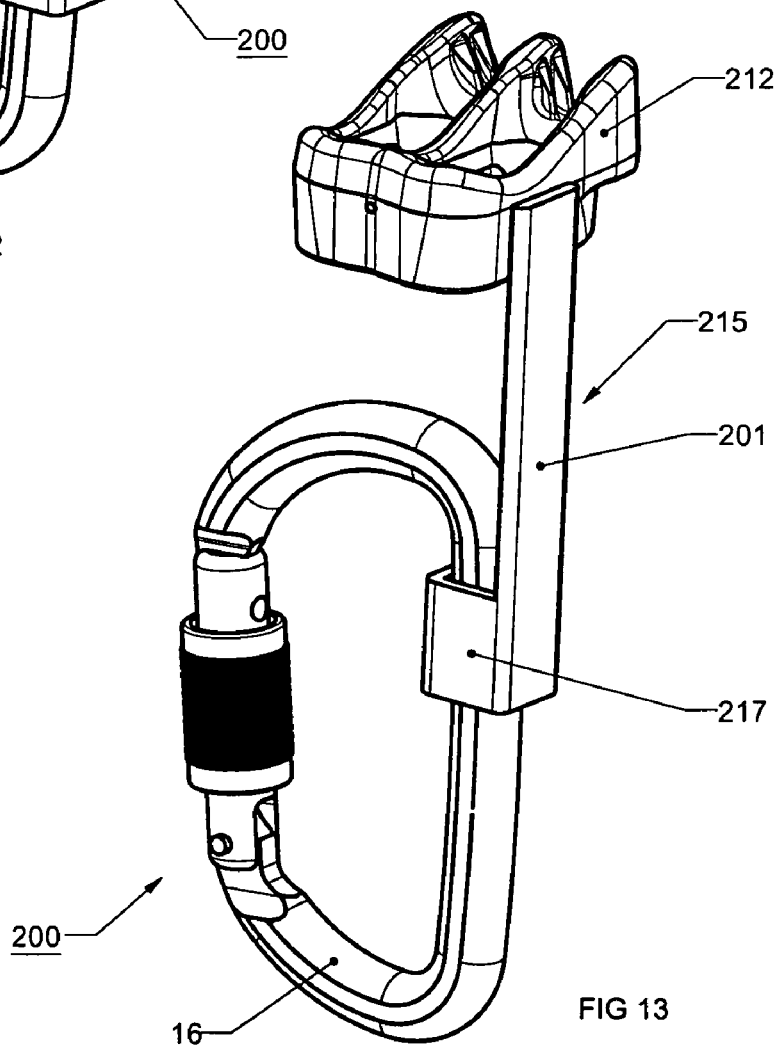

FIGS. 12 and 13 illustrate another alternative embodiment of a belay device 200 with plate 212 of the same type as that of FIGS. 1-9. Retaining element 215 is formed by a single rigid support arm 201 integral to a metal plate 212. At the opposite end, support arm 201 supports a securing part 217 enabling bidirectional sliding of carabiner 16 along said arm. In FIG. 12, carabiner 16 is up against the stop formed by the bottom surface of plate 212. FIG. 13 represents carabiner 16 separated from plate 212 when the rope is released.

The invention claimed is:

1. A belay device for a rope, comprising:

a plate having at least one slot for a loop of the rope to pass through, a retaining element formed by a semi-rigid cable in the form of a shackle fixed to the plate and extending perpendicularly to the plate, a carabiner connected to the cable of the retaining element by a securing part, the securing part being formed by a clip comprising a first opening for the carabiner to pass through with clearance and a second opening in which a portion of the retaining element is inserted, and wherein the carabiner is mounted with bidirectional sliding in the hole of the clip to come up against the plate when the rope is blocked or to move away from the plate when the rope is released, wherein the clip is made from plastic and is formed by two parts that clip onto the cable, wherein the two parts constituting the clip are assembled to one another forming a V shape, and wherein one of the parts of the clip comprises a protuberance in which the hole for sliding of the carabiner is arranged.

2. The belay device according to claim 1, wherein the plate comprises two parallel slots separated from one another by an intermediate wall whereto the retaining element is fixed.

3. The belay device according to claim 2, wherein the plate is further provided with a pair of holes arranged on each side of the slots and designed for belaying the leader and the second climber.

* * * * *